United States Patent [19]

Link et al.

[11] 4,385,515

[45] May 31, 1983

[54] CALIBRATED CABLE CONNECTOR CRIMPING TOOL AND METHOD OF USE

[75] Inventors: William T. Link, Berkeley; Joel L. Fritsche, Redwood City; Donald E. Crisp, Hayward, all of Calif.

[73] Assignee: Raychem Corporation, Menlo Park, Calif.

[21] Appl. No.: 319,817

[22] Filed: Nov. 9, 1981

[51] Int. Cl.[3] ..... B21D 37/10

[52] U.S. Cl. ..... 72/416; 72/404; 72/472

[58] Field of Search ..... 72/416, 412, 410, 403, 72/404, 470, 472; 29/517

[56] References Cited

U.S. PATENT DOCUMENTS

| | | | |
|---|---|---|---|
| 402,045 | 4/1889 | Taylor | 72/404 |
| 519,817 | 5/1894 | Mette | 72/404 |
| 765,825 | 7/1904 | Felker | 72/404 |
| 2,247,928 | 7/1941 | Temple | 29/517 |
| 2,774,269 | 12/1956 | Demler | 72/472 |
| 3,101,766 | 8/1963 | Floyd | 72/412 |
| 4,043,174 | 8/1977 | Paolino | 72/472 |
| 4,118,971 | 10/1978 | Izraeli | 72/410 |
| 4,140,001 | 2/1979 | Moulton | 72/416 |

*Primary Examiner*—Gene Crosby

*Attorney, Agent, or Firm*—Herbert G. Burkard; James W. Peterson; Gail-Deanna Salasny

[57] ABSTRACT

A versatile, calibrated cable connector crimping tool capable of crimping a plurality of cable connector sizes and a method of forming a calibrated crimp or a plurality of calibrated crimps in a cable splice connector positioned around a cable splice along a cable using said crimping tool are disclosed. The crimping tool comprises a first die member having a plurality of dies of select sizes, a second die member having a single die of select size, and a hinge joint connecting said die members and allowing them to be swung into engagement. One die member has a die or dies which are spatially fixed to define a fixed die member. The other die member has a moving means along which the die or dies may be moved into a position allowing engagement of the die members to define a movable die member. A die of select size, appropriate as defined herein for the size of the connector and the cable, is selected from among the plurality of dies of the first die member and the movable die member is moved into a position allowing engagement of the die members. The tool is positioned about the connector and struck until said first and second die members engage, thereby forming a calibrated crimp.

12 Claims, 3 Drawing Figures

CALIBRATED CABLE CONNECTOR CRIMPING TOOL AND METHOD OF USE

BACKGROUND OF THE INVENTION

1. Field of the Invention

This invention relates to crimping, and more particularly to a cable crimping tool and a method of forming a calibrated crimp in a cable splice connector positioned around a cable splice using said cable crimping tool.

2. Discussion of the Art

A cable as referred to herein, is an assembly of wire strands which may be used as electrical conductors and which have been laid up together into at least one core. Where there is more than one core, the cores are usually bundled or twisted together. Where there is more than one core and the cores are discrete electrical conductors, each core is electrically insulated from the others and laid up together, for example, by being bundled together or twisted around a central core. For the sake of simplicity and clarity, a reference to "cable" herein is meant to include a single-core cable or a multi-core cable. Likewise, a reference to "cable end(s)" herein is meant to include core end(s).

Cable ends may be spliced (i.e., united or joined) into in-line joints or splices in numerous ways. By way of illustration but not limitation, the strands may be interwoven (a braided lap joint), or spread apart somewhat and interdigitated (a crowsfoot lap joint), or knotted (a square knot joint). The ends may be lapped together (a simple lap joint), or butted together (a simple butt joint).

The permanence of cable splices may be improved by brazing the cable at or around the splice, soldering, welding, and the like, and/or by employing a mechanical connector, herein referred to as a "cable splice connector." The cable splice connectors discussed herein are cylinders of a mechanical malleable metal or alloy which are crimpable and which are positioned around a cable splice to surround it, usually by sliding the connector over one end of the cable before the splice is made. For applications where brazing the cable, soldering, welding, and the like, are not desirable, practical or feasible (e.g., cable splicing in underground mines where open flames are banned because of the presence of potentially explosive gasses), the strength of the joint may rely heavily on the cable splice connector and the quality of the crimp to the cable splice formed therein.

Cable connector crimping tools are known in the art and may be employed to securely fasten a crimpable cable splice connector to the cable splice. To "crimp" as used herein refers to pinching or pressing together two or more parts, at least one of which is malleable, in order to mechanically and/or electrically interconnect them. A crimping tool generally consists of a pair of dies which when closed around a crimpable cable splice connector positioned around a cable splice, pinches or presses together the connector and the cable splice contained therewithin, thereby firmly joining the parts together. The tool is subsequently removed. The tools discussed herein are of the type which are struck (as with a hammer). These are small, lightweight and easily transported, a distinct advantage over tools which are closed by other means, such as by a more massive vise which is turned, or by a plier-like pair of lever arms which tend to be long in order to provide the mechanical advantage required for closure.

Cable connector crimping tools are generally of two types, uncalibrated and calibrated. An uncalibrated crimping tool typically has a pair of dies, one die of which is a male (i.e., a convex shape), the other a female (i.e., a concave shape). When struck excessively, the connector and splice may be excessively thinned-out due to the malleable nature of most metals and some alloys. When this occurs the cable is weakened at the crimp. A calibrated crimping tool typically has a pair of dies, both of which are female dies (i.e., both concave shapes). When struck, these dies cannot be hammered down past a predetermined stop or stopping point and hence thinning-out of the connector and splice does not occur and the tool is said to produce a calibrated crimp. Calibrated crimping tools are clearly preferred.

Known calibrated cable connector crimping tools which are struck lack versatility in that each tool or pair of tool inserts crimp only one connector size. Examples of such one-size tools are the Burndy Beat Block BBM and the Burndy Hypress, both commercially available from the Burndy Corporation of Norwalk, Conn.

SUMMARY OF THE INVENTION

The purpose of the instant invention is to provide a versatile, calibrated cable connector crimping tool capable of crimping a plurality of cable connector sizes and a method of forming a calibrated crimp or a plurality of calibrated crimps in a cable splice connector positioned around a cable splice along a cable using said versatile, calibrated cable connector crimping tool.

To accomplish this purpose, a cable connector crimping tool for forming a calibrated crimp of selectably variable size in a cable splice connector positioned around a cable splice when the tool is struck is provided, comprising:

(a) a first die member having a plurality of dies of select sizes linearly arranged in a sawtooth-like select sequence, each die comprising a V-groove having a first face and a second face, said faces being of equal length and being joined at the base point of the V-groove, each face extending out at an angle of 45° from the vertical axis of the V-groove at its base point and having an outer end, the outer end of the second face of each die intersecting the outer end of the first face of the adjacent die, the outer end of the first face of a first die in the sequence and the outer end of the second face of a last die in the sequence intersecting the outer ends of partial V-grooves juxtaposed thereto;

(b) a second die member having a single die comprising a V-groove of larger scale than the V-grooves of the first die member, having a first face and a second face, said faces being of equal length and being joined at the base point of the V-groove, each face extending out at an angle of 45° from the vertical axis of the V-groove at its base point and having an outer end; and (c) a hinge joint connecting the first die member and the second die member so that they can be engaged to form a calibrated diamond-shaped aperture into which the cable splice connector positioned around the cable splice may be placed prior to striking the tool, one die member having a die or dies which are spatially fixed to define a fixed die member, the other die member having a moving means along which the die or dies may be slideably moved into a position allowing engagement to define a moveable die member, the faces of the second die member surrounding one of the dies of the first die member by partially engaging the faces of the dies of the first die member adjacent to said one die, provided that the sequence of sizes of dies in the first die member is such that the outer ends of the faces of the second die never reach the base points of the V-grooves of the first die member whose die faces said first die member partially engages when said first and second die members are engaged.

The cable crimping tool may further comprise a horizontal base member whose mass increases the inertia of the tool when it is struck. The tool may further comprise a moving means for the movable die member, which is a track and a rod extending out on either side of said movable die member, which cooperate to allow the movable die member to slide along said track. A strike pad and a handle portion may additionally be employed.

The invention also provides a method of forming a calibrated crimp in a cable splice connector positioned around a cable splice along a cable or cables having determinable size, comprising the steps of:

(a) threading a crimpable cable splice connector of select size appropriate for the cable size onto and past one of two ends of the cable or cables to be spliced;

(b) positioning in either an abutting or an overlapping relationship, the ends to form a cable splice;

(c) positioning the crimpable cable splice connector around said cable splice;

(d) providing a cable crimping tool as previously described;

(e) selecting a die of select size appropriate for the size of the connector and the cable from among the plurality of dies of said movable die member;

(f) slideably moving said selected die of said movable die member into a position from which it can be engaged with said fixed die member;

(g) inserting said cable splice connector positioned around said cable splice into said selected die of said movable die member;

(h) closing said crimping tool around said connector by pivoting about said hinge joint thereby bringing the second die member into a position from which it can engage said first die member when the tool is struck;

(i) striking said cable crimping tool until said first and second die members engage, thereby forming a calibrated crimp.

Where the cable has electrical insulation, the method may further include the step of stripping the electrical insulation prior to splicing the cable ends. The method may be repeated to form a plurality of crimps along the same connector and may optionally further comprise the step of rotating the cable splice connector positioned around a cable splice by 45° in between the formation of successive crimps.

BRIEF DESCRIPTION OF THE DRAWING

The invention may be better understood by referring to the detailed description of the invention when taken in conjunction with the accompanying drawing in which.

DETAILED DESCRIPTION OF THE INVENTION

Figure 1:
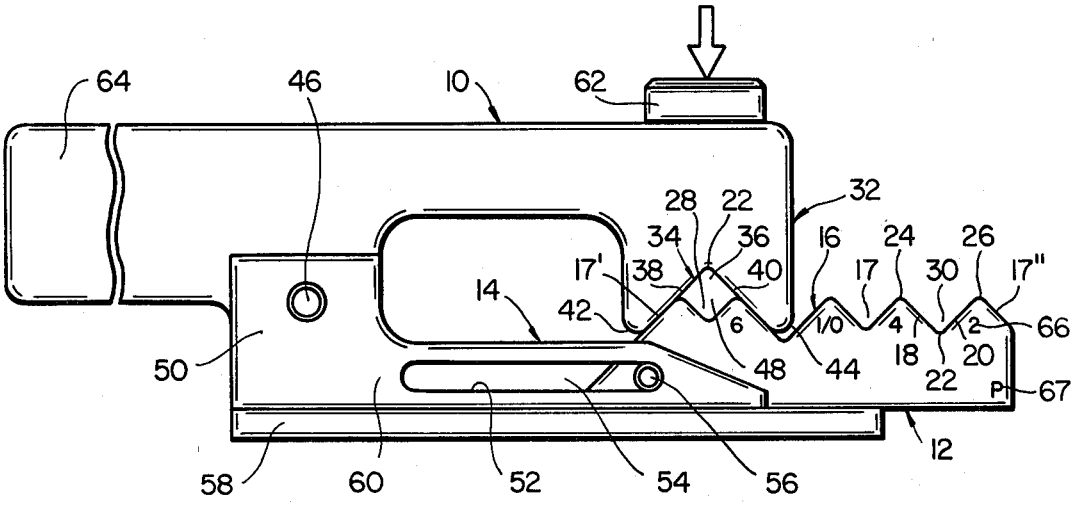
FIG. 1 is a side view of a calibrated cable crimping tool according to this invention.

The calibrated cable connector crimping tool of this invention is a tool, fabricated preferably from tool quality metals or alloys, most preferably from hardened tool quality metals or alloys, for crimping a crimpable cable splice connector down onto and around a cable splice formed by positioning in either an abutting or an overlapping relationship, the ends of a cable or cables comprised of an assembly of metal wire strands. Where the cable comprises one or more cores, especially where the cores are discrete electrical conductors, each core then being electrically insulated, the cores are individually spliced together, insulation being partially stripped away if present, and one splice connector is used for each spliced core.

The tool is versatile in several ways. No known crimping tool having dies integral thereto and which is struck is capable of crimping a plurality of connector sizes. A novel pair of die members, one fixed, the other movable, allows die size selection to suit connectors for cable sizes ranging from 6 to 4/0 AWG. The pair of die members engage in a novel way to provide a diamond-shaped, calibrated crimp when the tool is struck. Overcrimping which destructively thins-out and weakens the cable is not possible. Undercrimping which results in a weak joint is rendered unlikely. Finally, the preferred width of the die members, $\frac{3}{8}$ inch, and the geometries of the tool, not only provide a single crimp with excellent pull-out strength, but also allow adjacent multiple crimps to be struck along the same connector, which further improves pull-out strength, especially and preferably when the cable is turned by 45° in between successive crimps.

The preferred crimp is one which reduces a cross-section through the crimped connector and spliced, stranded metal wire cables (or core) to solid metal, totally devoid of gaps. This provides the maximum pull-out strength and the maximum long-term stability, since there are no gaps into which the metal wire strands can cold flow and thereby tend to separate from the crimped connector.

The preferred cable splice connector is one which is selected to manually fit over the cable splice (or core splice) so that the assembly does not tend to fall apart before the tool is struck; that is, the fit is neither too loose nor too tight. Thus, "a crimpable cable splice connector of select size appropriate for the cable size" is a connector which can be crimped down onto and around a cable splice to produce a crimp having a cross-section through the connector and the splice, which is at least about 85% solid metal, preferably at least about 90% metal, most preferably at least about 95% metal, and especially about 100% metal. Connector manufacturers typically market cable size designated connectors.

The preferred die size is one which is selected to produce a crimp as close to the preferred crimp, as defined above, as possible. Thus, "a die of select size appropriate for the size of the connector and the cable" is, in the context of this invention, a die selected from one of the dies of the movable die member, which when engaged with the die of the fixed die member and struck until the predetermined stop or stopping point designed into the tool is reached (hence giving rise to the designation "a calibrated cable connector crimping tool"), produces a crimp having a cross-section through the connector and the splice which is at least about 85% solid metal, preferably at least about 90% metal, most preferably at least about 95% metal, and especially about 100% metal.

It is convenient to size-designate the die size according to cable size, as connectors are typically sized according to cable size, but that requires that the types of in-line splice, butt or parallel (i.e., lapped) be taken into consideration. A rule of cross-sectional area correspondence was noted for cable sized by the AWG system. A butt-spliced cable has obviously a cross-sectional area which is half that of a parallel-spliced cable of the same size. Conveniently, a parellel-spliced cable of AWG size which is three AWG sizes smaller occupies approximately the same cross-sectional area as a butt-spliced cable of a certain AWG size. For example, a parallel-spliced, size 2 AWG cable occupies approximately the same cross-sectional area as a butt-spliced size 2/0 AWG cable, i.e., three AWG sizes smaller, to wit (2, 1, 1/0, 2/0).

Referring to FIG. 1, a preferred embodiment of this invention is shown in a side view. The cable crimping tool shown generally at 10 comprises a first die member shown generally at 12, shown in its preferred position as the lower die member and as the movable die member, although it could alternately be the upper die member and in either event be the fixed or movable die member. The first die member 12 has a moving means shown generally at 14 and a plurality of dies 16 of select sizes linearly arranged in a sawtooth-like select sequence to be discribed subsequently.

Each die 16 comprises a V-groove such as the one shown at 17, having a first face 18 and a second face 20, both faces being of equal length and being joined at the base point 22 of the V-groove 17. Each face 18, 20 extends out at an angle of 45° from the vertical axis of the V-groove 17 at its base point 22 and has an outer end 24, 26 respectively. The outer end 26 of the second face 20 of each die intersects the outer end 24 of the first face 18 of the adjacent die. The outer end 24 of the first face 18 of a first die in the sequence 28 and the outer end 26 of the second face 20 of a last die in the sequence 30, intersect the outer ends of partial V-grooves 17' and 17'' respectively.

With continuing reference to FIG. 1, the cable crimping tool 10 further comprises a second die member shown generally at 32, shown in its preferred position as the upper die member and as the fixed die member, although it could alternately be the lower die member and in either event be the fixed or the movable die member. The second die member 32 has a single die shown generally at 34 comprising a V-groove 36 of larger scale than the V-grooves 17 of the first die member 12 and having a first face 38 and a second face 40. The faces 38, 40 are of equal length and are joined at the base point 22 of the V-groove 36. Each face extends out at an angle of 45° from the vertical axis of the V-groove 36 at its base point 22 and has an outer end 42, 44 respectively.

Figure 3:
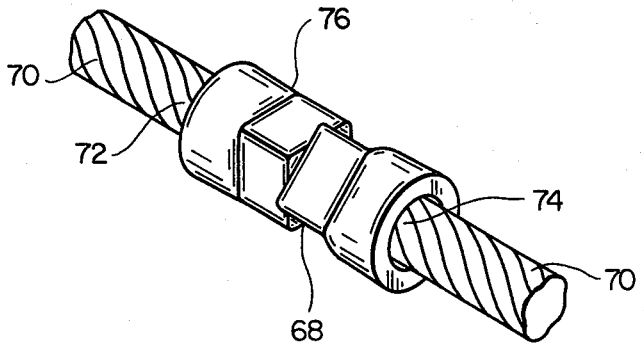
FIG. 3 is a perspective view of a double crimp formed according to this invention, in which the connector placed around a butt-style cable splice in a rope stranded cable was rotated by 45° after the first crimp.

The cable crimping tool 10 of FIG. 1 also comprises a hinge joint 46 connecting the first die member 12 and the second die member 32 so that they can be swung together in engagement to form a calibrated diamond-shaped aperture 48 into which a cable splice connector positioned around the cable splice (such as shown in FIG. 3) may be placed prior to striking the tool. The faces 38, 40 of the second die member 32 engage with the first die member 12 by surrounding one of the dies 16 of the first die member 12 by partially engaging the faces 18, 20 of the dies 16 of the first die member 12 adjacent to said one die 16.

The sequence of sizes of the dies 16 in the first die member 12 is important for the proper functioning of this variable connector size tool. The required sequence is such that the outer ends 42, 44 of the faces 38, 40 of the second die member 32 never reach the base points 22 of the V-grooves 17 of the first die member 12, whose die faces 18, 20 the first die member 12 partially engages when the first and second die members 12, 36 respectively are engaged. This is accomplished by surrounding a shallow V-groove 17 by deeper V-grooves 17 or a partial V-groove 17' or 17''.

The moving means 14 of the first die member 12 is shown in FIG. 1 as comprising a pair of spaced-apart vertical members 50. Vertical members 50 each have matching horizontal slots 52, the slots 52 cooperating to form a track 54 therebetween and therealong. The moving means 14 also comprises a horizontal rod 56 extending out on either side of the first die member 12 and cooperating with the track 54 to allow the first die member 12 to slideably move along the track. The movement of the first die member 12 allows one die 16 selected as the appropriate size for the connector and cable splice to be positioned properly.

The cable crimping tool 10 may further comprises a horizontal base member 58 (shown in FIG. 1) whose mass increases the inertia of the tool 10 when it is struck. The base member 58 is connected to the lower die member, shown here as the first die member 12, by means of a connection means 60, connected to the first die member 12 on the side of the die member 12 remote the dies. In this view, the connection means 60 is a part of the moving means 14 just as it would be if alternately the second die member 32 was the movable die member. When the lower die member is the fixed die member, the base member 58 is connected to the fixed die member on the side remote the die or dies.

With continuing reference to FIG. 1, the tool 10 may further comprise a strike pad member 62 as shown, positioned on the uppermost die member remote the die or dies and centered over and along the vertical axis of the diamond-shaped aperature 48 formed when the die members 12, 32 are engaged. Strike pad member 62 is shown positioned on the second die member 32. Alternately, when the uppermost die is the first die member 12, the strike member 62 is positioned on the first die member 12.

FIG. 1 also shows the tool 10 as further comprising a handle portion 64. Handle portion 64 extends out from the uppermost die member at the hinge joint 46 on the side of the die member 12 or 32 remote the die 34 or dies 16. The handle facilitates closing the tool 10 by pivoting around hinge joint 46. It allows a positive pressure to be applied to the cable splice connector positioned around the cable splice thereby facilitating holding the connector, etc. in place until the tool 10 is struck. Here the handle portion 64 extends out from the uppermost die member which is the second die member 32. It could alternately extend out from the first die member 12, when that die member is the upper die member.

With continuing reference to FIG. 1, numerical designations such as the one indicated at 66 are placed on the first die member 12 adjacent to each die 16 to facilitate die selection. The numerical designations 66 used correspond to cable sizes and the type of in-line splice, butt or parallel (i.e., lapped). Capital letters 67, "P" or "B" may be placed on the first die member 12 to indicate the type of in-line splice, i.e., "P" for parallel or "B" for butt (not shown). Thus, a numerical designation 66 of "2" on the "P" side of die member 12 adjacent to a die 16, indicates that an adequate crimp according to this invention will be obtained when a cable splice connector of cable size designation "2P" (or the like) is crimped down onto a parallel type of in-line splice formed by overlappingly splicing the ends of a 2 AWG size cable by means of any of the lapped-type in-line splices previously discussed herein. Since the single cable cross-sectional are of 2 AWG cable is 0.05212 $inch^2$ and of 2/0 AWG cable is 0.1045 (i.e., roughly a factor of 2 times the area of 2 AWG), a connector designated "2/0 B" (or the like) may be crimped down onto a butt-spliced size 2/0 AWG cable using the same die 16 as was used to crimp a "2P" (or the like) connector down onto a parallel-spliced size 2 AWG cable. A similar correspondence in cross-sectional area exists for other cable sizes when butt-versus parallel-spliced. Thus, for example, as shown in FIG. 1, the sequence of dies 16 of the first die member 12 may be numbered on the "P" side from left to right, by the numerical designations 66, as "6," "1/0," "4," and 37 2." Then, the obverse side of first die member 12, the "B" side (not shown), may have its dies 16 correspondingly numbered by the numerical designations, "3," "4/0," "1," and "2/0" respectively, according to the rule of correspondence previously discussed, such that "3" on the "B" side corresponds to "6" on the "P" side, etc.

Figure 2:
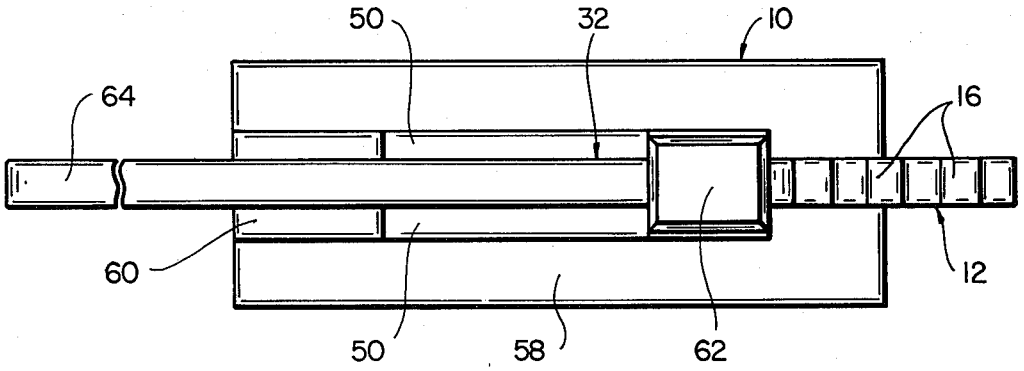
FIG. 2 is a top view of the tool of FIG. 1.

FIG. 2 is a top view of the cable crimping tool 10 of FIG. 1.

FIG. 3 is a perspective view of a double crimp formed in a connector placed around a butt-style cable splice 68 according to this invention. Cable 70 has cable ends 72, 74 which have been spliced, provided with a crimpable cable splice connected 76 and crimped twice using a crimping tool 10 according to this invention. The second crimp was made after the connector placed around a cable splice 68 was rotated 45°. Multiple crimping improves pull-out strength compared to single crimping. Rotating by 45° in between crimps along the same connector 76 further improves pull-out strength. Where the cable (or cable cores) are insulated, the crimping procedure includes the step of stripping the electrical insulation away from the cable ends (or cable core ends) prior to splicing the cable ends, thereby allowing the splice to be made.

While the instant invention has been described by reference to what is believed to be the most practical embodiments, it is to be understood that the invention may embody other specific forms not departing from the spirit of the central characteristics of the invention. It should be understood that there are other embodiments which possess the qualities and characteristics which would generally function in the same manner and should be considered within the scope of this invention. The present embodiments therefore should be considered in all respects as illustrative and not restrictive, the scope of the invention being limited solely to the appended claims rather than the foregoing description and all equivalents thereto being intended to be embraced therein.

We claim:

1. A cable connector crimping tool for forming a calibrated crimp of selectably variable size in a cable splice connector positioned around a cable splice when the tool is struck, comprising:

(a) a first die member having a plurality of dies of select sizes linearly arranged in a sawtooth-like select sequence, each die comprising a V-groove having a first face and a second face, said faces being of equal length and being joined at the base point of the V-groove, each face extending out at an angle of 45° from the vertical axis of the V-groove at its base point and having an outer end, the outer end of the second face of each die intersecting the outer end of the first face of the adjacent die, the outer end of the first face of a first die in the sequence and the outer end of the second face of a last die in the sequence intersecting the outer ends of partial V-grooves juxtaposed thereto;

(b) a second die member having a single die comprising a V-groove of larger scale than the V-grooves of the first die member, having a first face and a second face, said faces being of equal length and being joined at the base point of the V-groove, each face extending out at an angle of 45° from the vertical axis of the V-groove at its base point and having an outer end; and (c) a hinge joint operatively connecting the first die member and the second die member so that they can be engaged to form a calibrated diamond-shaped aperture into which the cable splice connector positioned around the cable splice may be placed prior to striking the tool, one die member having a die which is spatially fixed to define a fixed die member, the other die member having a moving means along which the die or dies may be slideably moved into a position allowing engagement of the die members to define a movable die member, the faces of the second die member surrounding one of the dies of the first die member by partially engaging the faces of the dies of the first die member adjacent to said one die, provided that the sequence of sizes of dies in the first die member is such that the outer ends of the faces of the second die never reach the base points of the V-grooves of the first die member, whose die faces said first die member partially engages when said first and second die members are engaged.

2. A cable connector crimping tool according to claim 1, which further comprises a horizontal base member whose mass increases the inertia of the tool when it is struck and which is connected to the fixed die member on the side remote from the die.

3. A cable connector crimping tool according to claim 1, which further comprises a horizontal base member whose mass increases the inertia of the tool when it is struck and which is connected to said movable die member on the side of the die member remote from the die or dies by means of a connection means.

4. A cable connector crimping tool according to claim 1, wherein the moving means of the movable die member comprises a pair of spaced-apart vertical members, each having matching horizontal slots, the slots cooperating to form a track therebetween and therealong, and a horizontal rod extending out on either side of said movable die member and cooperating with said track to allow said movable die member to slide along said track.

5. A cable connector crimping tool according to claim 3, wherein the connection means for connecting said movable die member to said horizontal base member comprises said moving means.

6. A cable connector crimping tool according to claim 1, which further comprises a strike pad member positioned on the uppermost die member remote from the die and centered over the along the vertical axis of the diamond-shaped aperture formed when the die members are engaged.

7. A cable connector crimping tool according to claim 1, which further comprises a handle portion extending out from the uppermost die member at the hinge joint on the side of the die member remote from the die.

8. A cable connector crimping tool according to claim 1, wherein the first and second die members have a die width of ⅜ inch, said die width providing a corresponding crimp width when the tool is struck.

9. A method of forming a calibrated crimp in a cable splice connector positioned around a cable splice along a cable having a determinable size, comprising the steps of:

(a) threading a crimpable cable splice connector of select size appropriate for the cable size onto and past one of two ends of the cable to be spliced;

(b) positioning in a joining relationship, the ends of the cables to form a cable splice;

(c) positioning the crimpable cable splice connector around said cable splice;

(d) providing a cable crimping tool for forming a calibrated crimp in said cable splice connector positioned around said cable splice when the tool is struck, comprising:

(i) a first die member having a plurality of dies of select sizes linearly arranged in a sawtooth-like select sequence, each die comprising a V-groove having a first face and a second face, said faces being of equal length and being joined at the base point of the V-groove, each face extending out at an angle of 45° from the vertical axis of the V-groove at its base point and having an outer end, the outer end of the second face of each die intersecting the outer end of the first face of the adjacent die, the outer end of the first face of a first die in the sequence and the outer end of the second face of a last die in the sequence intersecting the outer ends of partial V-grooves juxtaposed thereto;

(ii) a second die member having a single die comprising a V-groove of larger scale than the V-grooves of the first die member, having a first face and a second face, said faces being of equal length and being joined at the base point of the V-groove, each face extending out at an angle of 45° from the vertical axis of the V-groove at its base point and having an outer end; and (iii) a hinge joint connecting the first die member and the second die member so that they can be engaged to form a calibrated diamond-shaped aperture into which the cable splice connector positioned around the cable splice may be placed prior to striking the tool, one die member having a die which is spacially fixed to define a fixed die member, the other die member having a moving means along which the die may be slideably moved into a position allowing engagement to define a movable die member, the faces of the second die member surrounding one of the dies of the first die member by partially engaging the faces of the dies of the first die member adjacent to said one die, provided that the sequence of sizes of dies in the first die member is such that the outer ends of the faces of the second die never reach the base points of the V-grooves of the first die member, whose die faces said first die member partially engages when said first and second die members are engaged;

(e) selecting a die of select size appropriate for the size of the connector and the cable from among the plurality of dies of said movable die member;

(f) slideably moving said selected die of said movable die member into a position from which it can be engaged with said fixed die member;

(g) inserting said cable splice connector positioned around said cable splice into said selected die of said movable die member;

(h) closing said crimping tool around said connector by pivoting about said hinge joint thereby bringing the second die member into a position from which it can engage said first die member when the tool is struck; and (i) striking said cable crimping tool until said first and second die members engage, thereby forming a calibrated crimp.

10. A method according to claim 9, wherein the cable comprises an electrical insulation layer or layers and which further comprises the step of stripping the electrical insulation away from the cable ends prior to positioning the cable ends thereby allowing the cable splice to be made.

11. A method according to claim 9, wherein a plurality of crimps are formed along the same cable splice connector positioned around a cable splice by repeating steps (f) thru (i) for each crimp.

12. A method according to claim 9, which further comprises the step of rotating the cable splice connector positioned around a cable splice by 45° in between the formation of successive crimps.

* * * * *